US005704196A

United States Patent [19]

Pazdernik et al.

[11] Patent Number: 5,704,196

[45] Date of Patent: Jan. 6, 1998

[54] HIGH SPEED BLANK SET-UP APPARATUS AND METHODS

[75] Inventors: Irvan L. Pazdernik; Dean Malmgren; Paul Wagner, all of Alexandria, Minn.

[73] Assignee: Douglas Machine Limited Liability Company, Alexandria, Minn.

[21] Appl. No.: 531,946

[22] Filed: Sep. 21, 1995

[51] Int. Cl.[6] ..... B65B 3/02; B65B 5/02

[52] U.S. Cl. ..... 53/458; 53/564; 53/566; 493/122; 493/123; 493/422

[58] Field of Search ..... 53/458, 457, 564, 53/566, 559, 579, 578; 493/181, 122, 123, 167, 174, 179, 422, 177

[56] References Cited

U.S. PATENT DOCUMENTS

| | | | |
|---|---|---|---|
| 2,090,559 | 8/1937 | Strauss | 53/579 |
| 2,125,147 | 7/1938 | Bergstein . | |
| 2,197,089 | 4/1940 | Anderson . | |
| 2,887,022 | 5/1959 | Lubersky et al. . | |
| 3,111,065 | 11/1963 | Jones et al. . | |
| 3,196,761 | 7/1965 | Ullman . | |
| 3,237,535 | 3/1966 | Gross . | |
| 3,300,946 | 1/1967 | Martin | 53/566 |
| 3,385,025 | 5/1968 | Lemelson | 53/578 |
| 3,435,738 | 4/1969 | Berney . | |
| 3,747,482 | 7/1973 | Berney . | |
| 3,763,750 | 10/1973 | Reichert . | |
| 3,911,799 | 10/1975 | Klund . | |
| 4,034,658 | 7/1977 | Sherman | 493/177 |
| 4,061,081 | 12/1977 | Pinto et al. . | |
| 4,197,789 | 4/1980 | Moen | 493/167 |
| 4,341,055 | 7/1982 | Williams et al. . | |
| 4,460,349 | 7/1984 | Charron . | |
| 4,471,601 | 9/1984 | Strombeck . | |
| 4,531,931 | 7/1985 | Dietrich | 53/566 |
| 4,549,876 | 10/1985 | Baker et al. . | |
| 4,578,054 | 3/1986 | Herrin . | |
| 4,626,234 | 12/1986 | Oxborrow . | |
| 4,636,187 | 1/1987 | Oakley . | |
| 4,807,428 | 2/1989 | Boisseau | 53/564 |
| 4,917,663 | 4/1990 | Pazdernik . | |
| 4,930,291 | 6/1990 | Boisseau . | |
| 5,027,586 | 7/1991 | Ramaker | 53/458 |
| 5,269,741 | 12/1993 | Fischer | 493/167 |

FOREIGN PATENT DOCUMENTS

| | | | |
|---|---|---|---|
| 472980A | 9/1991 | Denmark | 493/122 |

*Primary Examiner*—Lowell A. Larson
*Assistant Examiner*—Gene L. Kim
*Attorney, Agent, or Firm*—Peterson, Wicks, Nemer & Kamrath, P.A.

[57] ABSTRACT

Apparatus (10) for partially setting up a blank (12) is disclosed including first suction cups (122) for removing the first blank (12) from a magazine (96). The first suction cups (122) are pivotally mounted to the ends of pivot arms (110) to move the first blank (12) up and over actuators (102) of the magazine (96) as the first blank (12) is moved forward out of the magazine (96). After the lower edge of the first blank (12) passes over the actuators (102), the lower portion of the blank (12) is supported in an intermediate position upon an abutment bar (106). While still secured to the first suction cups (122), second suction cups (78) are secured to the blank (12). The second suction cups (78) tilt the blank (12) to be parallel to and move with upstanding lugs (36) of a conveyor assembly (34). A forming die (38) pushes the blank (12) into the lugs (36) as the forming die (38), blank (12) and the lugs (36) move at a constant speed. The end walls (22) of the blank (12) are slid under stationary guides (146) before the forming die (38) is slid from between the lugs (36) to allow movement of the partially set-up blank (12) with the conveyor assembly (34).

24 Claims, 4 Drawing Sheets

HIGH SPEED BLANK SET-UP APPARATUS AND METHODS

BACKGROUND

The present invention generally relates to packaging apparatus and methods, specifically to apparatus and methods for partially setting-up or forming planar blanks into containers, and particularly to apparatus and methods for partially setting-up or forming planar blanks into containers at high speeds.

Double-tiered, shrink-wrapped packages are often formed from paperboard or chip board which creates several package handling difficulties. For example, unlike corrugated stock, paperboard has a tendency not to initially fold along fold lines when setting up the blanks but rather tend to crease in any of a number of manners. Further, blanks formed from paperboard tend to bow or have an arcuate shape rather than being flat, with the direction of the arcuate shape being dependent on the particular direction that the blanks are cut from the paperboard stock. This detracts from the ability to accurately mechanically place paperboard blanks at the desired operative position. Placement within certain tolerance levels is especially important when forced folding is performed as well as for paperboard or the like where undesired creasing has a tendency to occur. Furthermore, double-tiered, shrink-wrapped packages are often utilized in the soft drink and similar industries. Production of soft drink cans occurs at relatively high rates of approximately 200 containers per minute. However, conventional apparatus for setting-up containers typically have production rates which are considerably below that for soft drink can production rates. Thus, it was required to utilize accumulators for temporarily holding soft drink cans or to utilize multiple set-up apparatus in each line which required considerable floor space.

Thus, a need exists for apparatus and methods for setting-up paperboard blanks in a manner to insure that folds occur along fold lines preformed in the blank and that the blank does not crease outside of the fold lines. Also, a need exists for apparatus and methods providing accurate mechanical placement of non-uniform blanks such as blanks formed of paperboard. Further, a need exists for container set-up apparatus and methods having increased production rates which better approximate the rates of production of articles to be contained in the container after set-up.

SUMMARY

The present invention solves these needs and other problems in the field of mechanical package handling and in particular of mechanically setting-up planar blanks by providing, in the preferred form, apparatus and methods for moving a forming die from an initial position, which is spaced in a slide direction from a female cavity, in the slide direction for pushing the blank into the female cavity as the female cavity moves in a movement direction at a non-linear angle to the slide direction and at a constant speed.

In a further aspect of the present invention, apparatus and methods are provided for removing the first blank of a plurality of blanks held in a magazine by moving the first blank in a direction parallel to the outside surface of the blank to move the lower edge of the blank to pass over a stop abutting with the outside surface of the first blank in the magazine while the first blank is being moved forward out of the magazine.

In still other aspects of the present invention, the blank is held relative to the female cavity by suction cups moving in the movement direction and simultaneously in the slide direction before the forming die slides the blank into the female cavity.

Thus, it is an object of the present invention to provide novel apparatus and methods for mechanically handling blanks.

It is further an object of the present invention to provide such novel apparatus and methods for mechanically handling blanks formed of paperboard or similar material.

It is further an object of the present invention to provide such novel apparatus and methods insuring that folds occur along fold lines preformed in the blank and that the blank does not crease outside of the fold lines.

It is further an object of the present invention to provide such novel apparatus and methods providing accurate mechanical placement of non-uniform blanks.

It is further an object of the present invention to provide such novel apparatus and methods having increased production rates.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
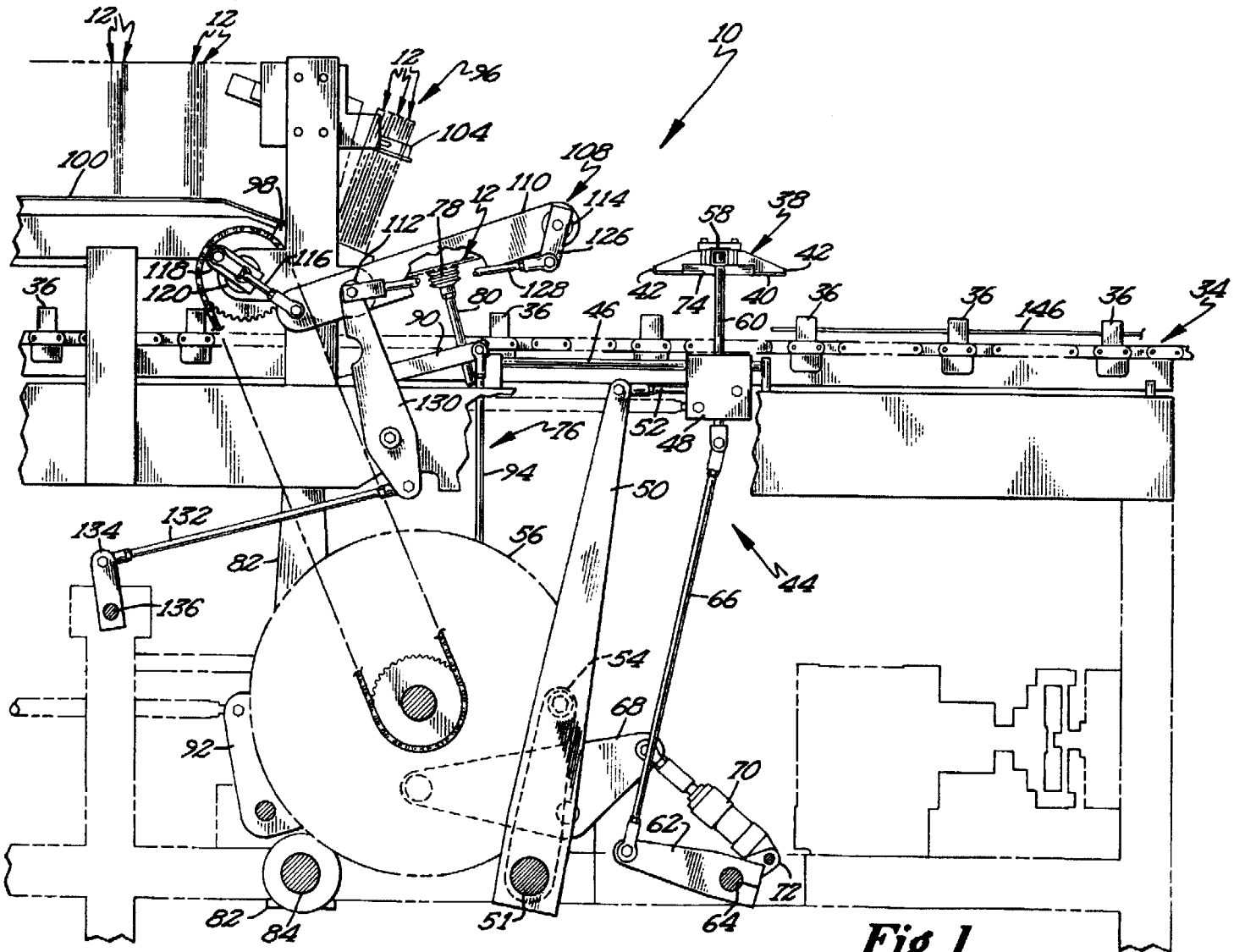
FIG. 1 shows a side elevational view of an apparatus for partially setting-up a planar blank according to the preferred teachings of the present invention, with portions broken away to show constructional details.
Figure 3:
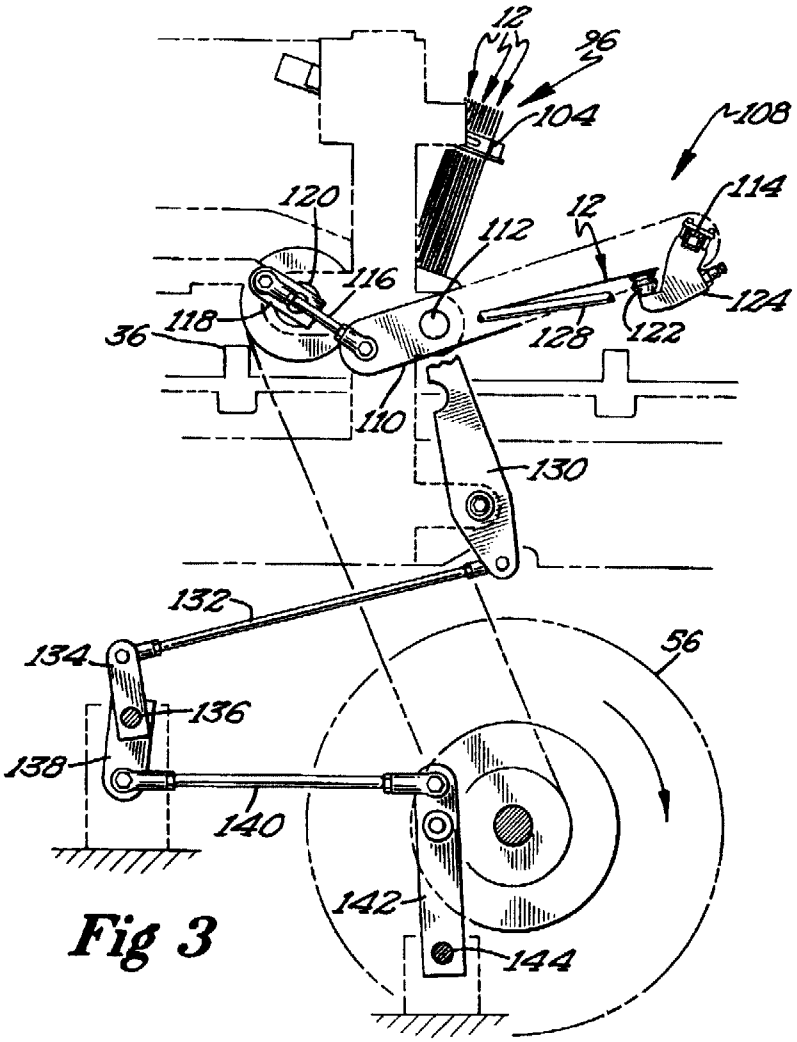
FIGS. 3–5 show partial, side elevational views of the apparatus of FIG. 1, with portions broken away to show constructional details.
Figure 2:
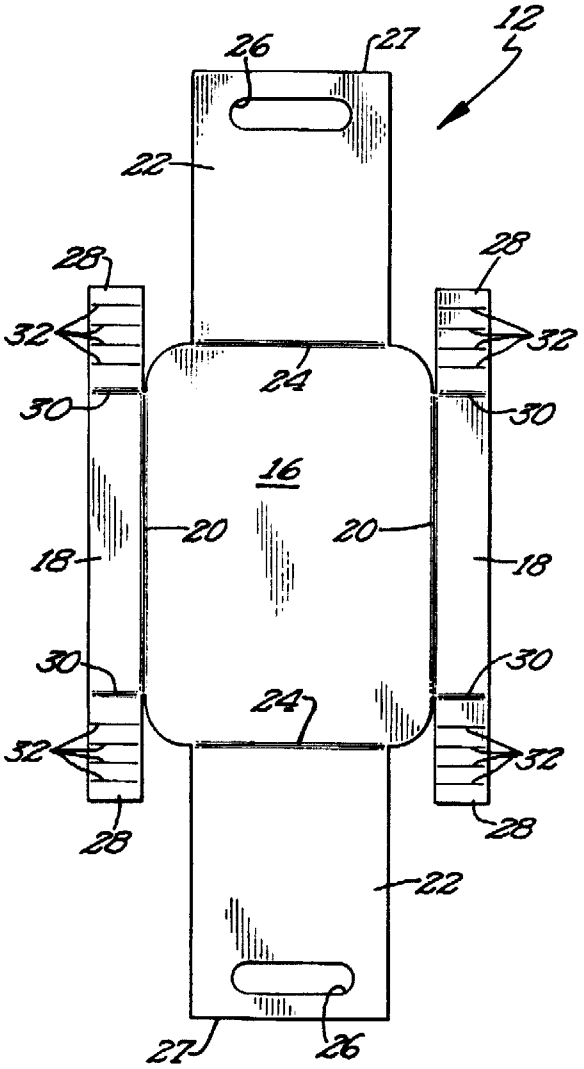
FIG. 2 shows a top plan view of the planar blank which is partially set-up by the apparatus of FIG. 1.
Figure 6:
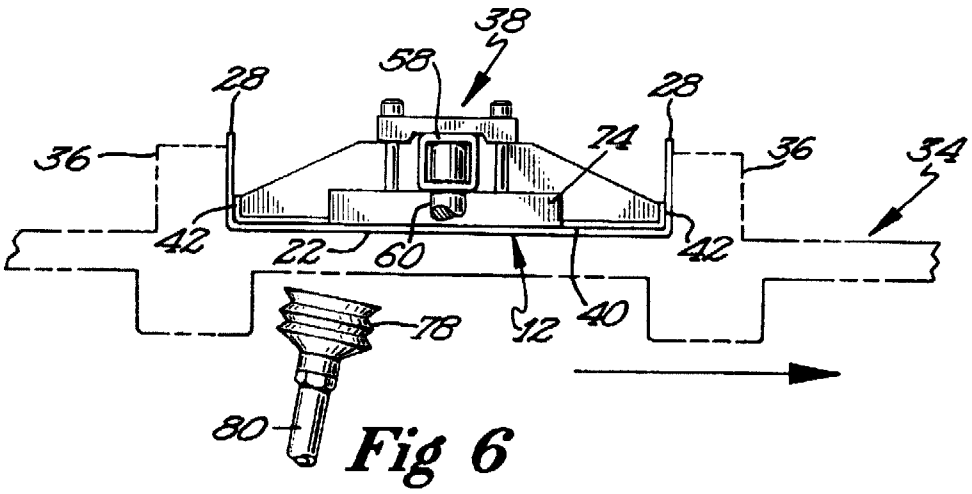
FIG. 6 shows a partial, diagrammatic, side elevational view of the apparatus of FIG. 1.
Figure 4:
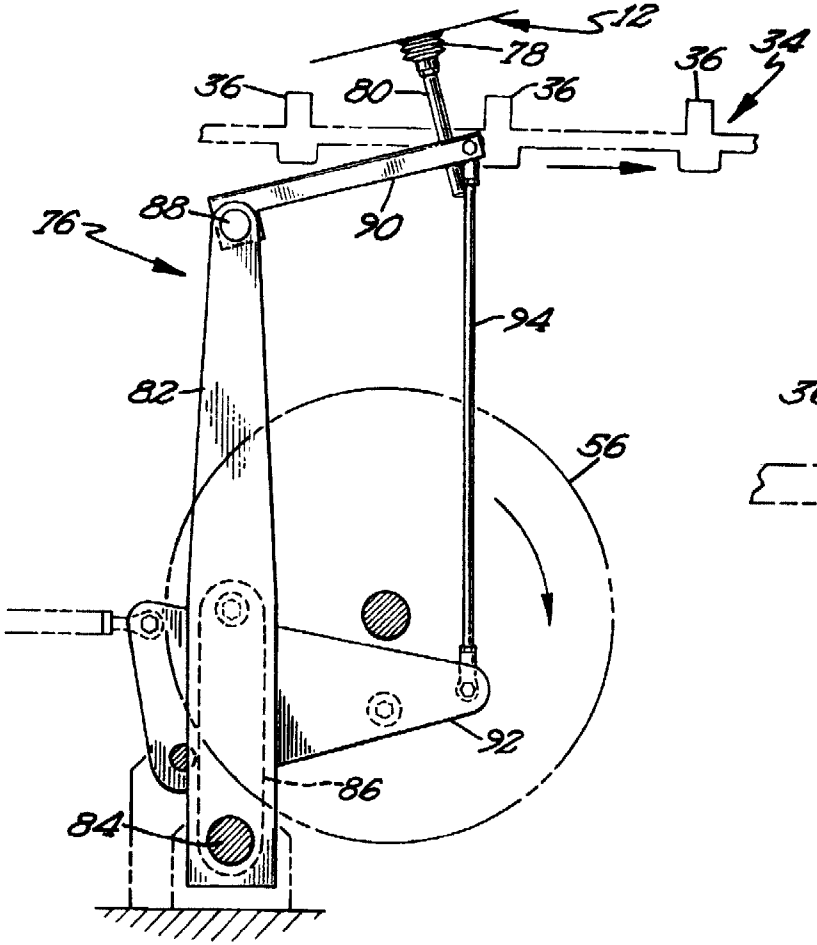
Figure 5:
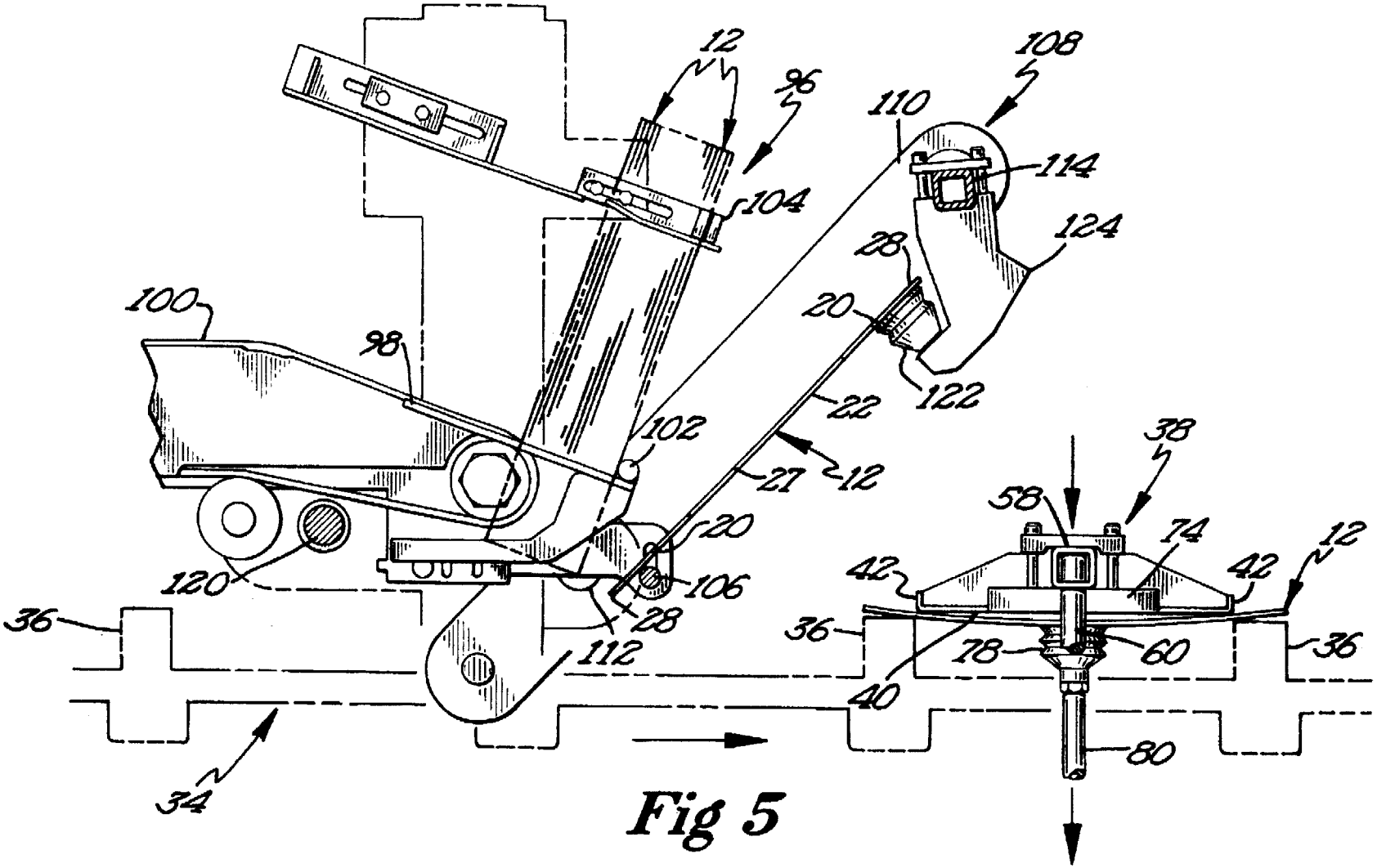

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "inside", "outside", "above", "below", "upper", "lower", "height", "width", "length", "end", "side", "horizontal", "vertical", "forward", "rearward", "longitudinal", "lateral", and similar terms are used herein, it should be understood that these terms have reference only to the structure shown in the drawings as it would appear to a person viewing the drawings and are utilized only to facilitate describing the illustrative embodiment.

DESCRIPTION

An apparatus for partially forming or setting-up a planar blank into a container according to the preferred teachings of the present invention is shown in the drawings and generally designated 10. In the most preferred form, blanks 12 are of the type shown and disclosed in U.S. patent application No. 08/337,325, which is hereby incorporated herein by reference. In particular, each blank 12 includes a base panel 16 which is substantially rectangular in plan and with rounded corners in the most preferred form. Side walls 18 of substantially rectangular configurations are joined or otherwise secured to the opposite sides of base panel 16 about parallel spaced fold lines 20. End walls 22 of substantially rectangular configurations are joined or otherwise secured to the opposite sides of base panel 16 about parallel spaced fold lines 24 which are perpendicular to fold lines 20. In the preferred form shown, the width of end walls 22 is less than the width of base panel 16. A notch serving as a handgrip 26 is located adjacent to the free, upper edge 27 of end wall 22. Tabs 28 are joined to side walls 18 about parallel spaced fold lines 30 which are perpendicular to fold lines 20 and parallel to fold lines 24, with fold lines 30 located inside and intermediate fold lines 24. In the most preferred form, tabs 28 are segmented about a multiplicity of fold lines 32 which are parallel to and spaced from fold lines 30. In the most preferred form, the length of end walls 22 between fold line 24 and edge 27 is dependent on whether a lower or an upper tray is desired to be formed.

Apparatus 10 generally includes a chain conveyor assembly 34 including a series of spaced, laterally extending projections or lugs 36 upstanding from and secured at longitudinally spaced locations to a chain. Lugs 36 and conveyor assembly 34 form or define female cavities for slideably receiving and containing blanks 12 to be partially formed. The longitudinal spacing between lugs 36 is generally equal to the spacing between fold lines 20 of panel 16.

Apparatus 10 according to the teachings of the present invention further includes a forming die 38 for slideable receipt in the female cavities defined by lugs 36 and conveyor 34. Specifically, die 38 in the preferred form is generally U-shaped including a central portion 40 and first and second leg portions 42 extending perpendicular from the opposite lateral front and rear edges of central portion 40. Central portion 40 has a shape and size corresponding to that of base panel 16. The longitudinal spacing between the front and rear edges of central portion 40 is generally equal to the spacing between fold lines 20 of panel 16 and the longitudinal spacing between adjacent lugs 36 and specifically allows die 38 to be slideably received in a slide direction perpendicular to the movement of lugs 36 which is in a vertical direction in the most preferred form. The lateral width of die 38 in the preferred form is generally equal to the spacing between fold lines 24 of panel 16. In the most preferred form, central portion 40 includes an enlarged aperture or other means for allowing air to communicate with the lower surface thereof.

Apparatus 10 according to the teachings of the present invention includes suitable provisions 44 for moving die 38 in a slide direction for slideable receipt of die 38 into and out of the female cavities defined by lugs 36 and conveyor assembly 34 and simultaneously at a constant speed equal to and in a movement direction parallel to the movement of lugs 36 which is at a non-linear angle and in the most preferred form perpendicular to the slide direction. In the most preferred form, first and second slide shafts 46 are arranged on opposite sides of conveyor assembly 34. A slide block 48 is slideably mounted on each shaft 46 for movement in a direction parallel to the movement of lugs 36. Suitable provisions are provided for reciprocating slide blocks 48 on shafts 46. In the preferred form, first and second pivot levers 50 upstand perpendicularly from a pivot shaft 51 and are located on opposite sides of conveyor assembly 34. The first ends of turnbuckles 52 are pivotally mounted to the free ends of pivot levers 50 and the second ends of turnbuckles 52 are pivotally mounted to slide blocks 48. Suitable provisions are provided for rotating shaft 51 such as a crank arm 54 secured to pivot shaft 51 and having a follower which engages a cam track of a cam drive 56. It can then be appreciated that movement of crank arm 54 due to rotation of cam drive 56 causes shaft 51 to rotate about its axis. Rotation of shaft 51 causes pivotable movement of levers 50 about the axis of shaft 51. Pivotable movement of levers 50 in turn causes blocks 48 to slide on shafts 46 due to the interconnection of turnbuckles 52 between levers 50 and blocks 48.

Die 38 is secured to a transverse or laterally extending bar 58 having ends located on opposite sides of conveyor assembly 34. First and second, spaced, parallel rods 60 are secured to the ends of bar 58 and are slideably received in slide blocks 48 for movement in a slide direction perpendicular to the movement of lugs 36 and to shafts 46 which is vertical in the most preferred form. Suitable provisions are provided for reciprocating rods 60 in slide blocks 48. In the preferred form, first and second pivot levers 62 extend perpendicularly from a pivot shaft 64 and are located on opposite sides of conveyor assembly 34. The first ends of crank arms 66 are pivotally mounted to the free ends of pivot levers 62 and the second ends of crank arms 66 are pivotally mounted to the lower, free ends of rods 60. Suitable provisions are provided for rotating shaft 64 such as a triangular-shaped crank lever 68 pivotally mounted about an axis extending laterally to conveyor assembly 34. An air cylinder 70 has a first end pivotally mounted to lever 68 and a second end pivotally mounted to a pivot ear 72 secured to shaft 64. A follower is provided on lever 68 for engaging a cam track of cam drive 56. It can then be appreciated that movement of lever 68 due to rotation of cam drive 56 causes shaft 64 to rotate due to its interconnection by air cylinder 70 and pivot ear 72. Rotation of shaft 64 causes pivotable movement of pivot levers 62 about the axis of shaft 64. Pivotable movement of levers 62 causes slideable movement of rods 60 due to the interconnection of arms 66 between levers 62 and rods 60. Slideable movement of rods 60 causes bar 58 and die 38 secured thereto to move in a slide direction which is perpendicular to the movement of lugs 36 and in a vertical direction in the most preferred form. It should be noted that air cylinder 70 in normal operation has a constant length. However, in the event that cam drive 56 should stop rotating while conveyor assembly 34 continues to operate, air cylinder 70 extends to insure that die 38 is spaced above lugs 36. It should also be noted that due to their common connection to cam drive 56, rods 60 are reciprocated in slide blocks 48 simultaneously as slide blocks 48 are reciprocated on shafts 46. In the preferred form, end wall bumpers 74 are secured to bar 58 on the opposite sides of die 38 extending parallel to the movement of lugs 36.

Apparatus 10 according to the preferred teachings of the present invention further includes suitable provisions 76 for pivoting blank 12 from an intermediate position extending at an acute angle in the order of 15° from the movement direction of lugs 36 to a parallel position to the movement direction of lugs 36 with blank 12 releasably held over one of the female cavities defined by lugs 36 and conveyor assembly 34 and simultaneously moving blank 12 at a constant speed equal to and in a direction parallel to the movement direction of lugs 36. In the preferred form, panel 16 is located between adjacent lugs 36 and sidewalls 18 extend thereover. In the preferred form, provisions 76 include multiple suction cups 78 for removable securement to the outside surfaces of blanks 12. Suction cups 78 are each attached to a straight length of tubing 80, with a source of vacuum, not shown, being secured to tubing 80. Provisions 76 further include first and second pivot levers 82 which upstand perpendicularly from a pivot shaft 84 and are located on opposite sides of conveyor assembly 34. Suitable provisions are provided for rotating shaft 84 such as a crank arm 86 secured to pivot shaft 84 and having a follower which engages a cam track of cam drive 56. A pivot shaft 88 is rotatably mounted to and between the free ends of pivot levers 82 about an axis generally parallel to and spaced from shaft 84. Each tubing 80 is secured generally perpendicular adjacent the free end of a link 90, with the opposite ends of links 90 secured generally perpendicular to shaft 88. Suitable provisions are provided for rotating shaft 88 relative to pivot levers 82 such as a crank arm 92 pivotally mounted about an axis and having a follower which engages a cam track of cam drive 56. Linkage 94 includes a first end pivotally mounted to crank arm 92 and a second end pivotally mounted to one of the links 90 adjacent its free end. It can then be appreciated that movement of crank arm 92 causes link 90 to pivot about an axis defined by shaft 88. As links 90 are secured to shaft 88, pivoting of link 90 causes rotation of shaft 88 due to the securement of links 90 thereto and also simultaneous pivoting of links 90 about the axis defined by shaft 88.

Rotation of shaft 84 causes pivotable movement of pivot levers 82 about the axis of shaft 84 causing movement of links 90 generally in a movement direction parallel to movement of lugs 36 but specifically along an arc having an axis of shaft 84. Pivoting of crank arm 92 causes pivotable movement of links 90 generally in a slide direction perpendicular to movement of lugs 36 but specifically along an arc having an axis of shaft 88. It should also be noted that due to their common connection to cam drive 56, suction cups 78 are reciprocated in a movement direction parallel to the movement of lugs 36 and simultaneously in a slide direction perpendicular to the movement of lugs 36 by provisions 76.

Apparatus 10 further includes a magazine 96 for holding a plurality of blanks 12 in an abutting relation with the outside surface abutting with the inside surface of the preceding blank and extending in a magazine direction which is generally parallel to the movement direction of lugs 36 in the preferred form. Magazine 96 generally includes first and second, spaced, parallel supports 98 for engaging the lower edges of end walls 18 laterally outside of tabs 28. Supports 96 each include a feed belt 100 which is driven by any suitable means such as an electric motor. At least the end portions of supports 98 are angled towards conveyor assembly 34 at an acute angle in the order of 25°. Stops in the preferred form of actuators 102 are pivotally mounted to the forward ends of supports 98 for actuating the drive for feed belt 100 such that feed belts 100 are driven when actuator 102 is not engaged by the outside surface of the first blank 12 and are not driven when actuator 102 is engaged by the outside surface of the first blank 12. It can then be appreciated that actuators 102 engage the outside surface of end walls 22 slightly above and adjacent to their lower edges and act as the lower stop for the first blank 12 in magazine 96. Stationary upper stops 104 are provided for abutting with the upper rounded corners of panel 16 intermediate the upper edges of end walls 22 and the lower edges of the upper tabs 28. It should then be appreciate that the preferred engagement position of actuators 102 and stops 104 is advantageous in allowing magazine 96 to be utilized on end walls 22 having differing lengths between fold lines 24 and edges 27 such as for forming a lower or an upper tray. The first blank 12 in magazine 96 is located at a relatively large acute angle to the movement of lugs 36 with the upper edges spaced forwardly of the lower edge and in the most preferred form at an angle in the order of 70°. A stationary, laterally extending abutment bar 106 is positioned adjacent the front of magazine 96 slightly vertically above lugs 36 and below actuators 102 and in the movement direction ahead of the lower edge of the lower side wall 18.

Apparatus 10 according to the teachings of the present invention further includes suitable provisions 108 for removing the first blank 12 from magazine 96 and moving it to its intermediate position. In the preferred form, provisions 108 generally include first and second pivot arms 110 located on opposite sides of conveyor assembly 34 and pivotable about a laterally extending frame axis 112 located intermediate the upper and lower ends of arms 110. A pivot shaft 114 is pivotally mounted to and between the upper ends of arms 110. Suitable provisions are provided for pivoting pivot arms 110 about axis 112. In the most preferred form, a turnbuckle 116 is provided having a first end pivotally mounted to the lower end of one of pivot arms 110 and a second end pivotally mounted to the free end of a crank arm 118 which is secured to a shaft 120. Shaft 120 is rotated by any suitable provisions such as through a sprocket and chain connected to cam drive 56. In the most preferred form, shaft 120 rotates 360° at a constant speed. A plurality of suction cups 122 are secured to shaft 114 by J-shaped mounts 124, with suction cups 122 being in fluid communication with a suitable source of vacuum, not shown, for removable securement to the outside surfaces of blanks 12. Suitable provisions are provided for rotating shaft 114 relative to pivot arms 110. In the most preferred form, a crank arm 126 is secured to shaft 114 and extends generally perpendicularly thereto. A first end of a turnbuckle 128 is pivotally mounted to the free end of crank arm 126. The second end of turnbuckle 128 is pivotally mounted to the upper end of a pivot lever 130. Pivot lever 130 is pivotally mounted intermediate its upper and lower ends about a pivot axis spaced and parallel to axis 112 and shaft 114. A first end of a turnbuckle 132 is pivotally mounted to the lower end of pivot lever 130. The second end of turnbuckle 132 is pivotally mounted to the free end of a crank arm 13. Crank arm 134 is secured to a pivot shaft 136. A second crank arm 138 is secured to pivot shaft 136 and extends in an opposite direction from shaft 136 than crank arm 134. A first end of a turnbuckle 140 is pivotally mounted to the free end of crank arm 138. The second end of turnbuckle 140 is pivotally mounted to the upper end of a pivot lever 142 pivotally mounted by its lower end about an axis 144 parallel to and spaced from axis 112 and shafts 120 and 136. Suitable provisions for pivoting lever 142 about axis 144 is provided such as a cam follower mounted on pivot lever 142 for engagement with a cam track of cam drive 56. In the most preferred form, axis 112 is located in the movement direction ahead of the bottom edge of first blank 12 in magazine 96. It can then be appreciated that due to their common connection to drive 56, suction cups 122 are moved in a movement direction generally parallel to the movement of lugs 36 but along an arc about axis 112 and simultaneously pivot about an arc having an axis defined by shaft 114.

Now that the basic construction of apparatus 10 according to the preferred teachings of the present invention has been set forth, the operation and advantages of apparatus 10 can be explained. For the sake of explanation, it will be assumed that blanks 12 are positioned in magazine 96, with the first blank 12 engaging actuators 102 and stops 104 (with feed belts 100 not being driven) and with conveyor assembly 34 operating with lugs 36 moving in the movement direction at a constant speed. It will be further assumed that provisions 108 are located in its initial position with suction cups 122 engaging the outside surface of blank 12 adjacent to its upper edge. In operation, pivot arms 110 are pivoted about axis 112 away from magazine 96. With vacuum applied to suction cups 122, movement of pivot arms 110 causes suction cups 122 to pull the first blank 12 from magazine 96 along an arc about axis 112. Specifically, blank 12 is pulled forwardly in the same direction as the movement of lugs 36. Additionally, blank 12 is simultaneously pulled in a blank direction parallel to the outside surface of blank 12 which is generally perpendicular to the movement of lugs 36 in the preferred form. In particular, due to the location of axis 112, blank 12 is at least initially pulled away from conveyor assembly 34 until shaft 114 reaches the top of its movement arc and then is pulled toward conveyor assembly 34 when shaft 114 passes the top of its movement arc. This initial movement away from conveyor assembly 34 tends to pull the lower edges of end walls 22 up and over actuators 102. It should be noted that if the first blank 12 were pulled forward or along an arc forward and towards conveyor assembly 34, a tendency exists for paperboard to fold or crease along actuators 102 which is undesirable.

It should be also noted that once pulled past actuators 102, the lower portions of blank 12 are no longer supported by supports 98. Since blank 12 is held by suction cups 122 adjacent its upper portions, blank 12 has a tendency to extend downwardly from suction cups 122 with lugs 36 engaging the lower edge of side wall 18. According to the teachings of the present invention when blank 12 is pulled past actuators 102, the lower portion of blank 12 engages abutment bar 106 such that blank 12 is supported by abutment bar 106 and suction cups 122, with the lower portion of blank 12 pivoting on abutment bar 106 as pivot arms 110 are pivoted forward. As the lower portion of blank 12 is supported by abutment bar 106, blank 12 does not engage lugs 36 according to the teachings of the present invention. Suction cups 122 are held in the same position relative to pivot arms 110 by cam drive 56 pivoting lever 142 until blank 12 generally reaches its intermediate position.

When blank 12 reaches its intermediate position, provision 76 is in its initial position. Specifically, suction cups 78 are spaced from the lugs 36 on the same side as die 38 and engage the outside surface of panel 16 of blank 12 generally intermediate fold lines 20. When vacuum is applied to suction cups 78, vacuum is released from suction cups 122. After release of suction cups 122, shaft 114 is rapidly rotated by cam drive 56 pivoting lever 142 to move suction cups 122 and mounts 124 outwardly of the top edge of the upper side wall 18 of blank 12. With suction cups 122 and mounts 124 in a non-obstructing position, pivot arms 110 are pivoted toward magazine 96 to the initial position of provisions 108.

Simultaneously, as provisions 108 are returning to their initial position, suction cups 78 are simultaneously moved by provisions 76 in the slide direction toward lugs 36 and in the movement direction at the constant speed of lugs 36. In this regard, blank 12 is pulled from abutment bar 106 to rest on trailing lug 36 and moved from an increasing angle to the movement direction of lugs 36 to a position parallel to the movement direction of lugs 36, with side walls 18 being supported on adjacent lugs 36 and panel 16 spanning therebetween. In the preferred form, suction cups 78 are slightly spaced below the top edges of lugs 36 to slightly bow panel 16 between the adjacent lugs 36 but without causing blank 12 to fold or crease. It can then be appreciated that when blank 12 reaches this entry position with panel 16 bowed between adjacent lugs 36, blank 12 is positioned longitudinally downstream from the initial position of provisions 76.

Prior to blank 12 reaching the entry position, die 38 is located in its initial position on the opposite side of blank 12 than suction cups 78. In its initial position, die 38 is located spaced in the slide direction from the female cavities defined by lugs 36 and conveyor assembly 34 which is perpendicular to the movement direction of lugs 36 and vertical in the most preferred form. From its initial position, die 38 is simultaneously moved in the slide direction toward lugs 36 and in the same direction and constant speed as lugs 36 by provisions 44. When blank 12 reaches the entry position, central portion 40 of die 38 engages the inside surface of panel 16 and pushes blank 12 toward conveyor assembly 34. After engagement of blank 12 by die 38, vacuum to suction cups 78 is released. After release of suction cups 78, links 90 are rapidly pivoted to move suction cups 78 in a direction opposite to die 38 and out of the female cavities and to space suction cups 78 below lugs 36. Pivot levers 82 are then pivoted towards magazine 96 to move suction cups 78 opposite to the movement direction of lugs 36 back to the initial position of provisions 76 with suction cups 78 again moving in and through the female cavity.

Simultaneously, as provisions 76 are returning to their initial position, die 38 continues to push panel 16 towards conveyor assembly 34 as well as move in the direction and speed of lugs 36. As blank 12 extends longitudinally beyond lugs 36, the portions of blank 12 extending longitudinally beyond die 38 will tend to fold about the lateral edges of central portion 40. It should then be noted that blank 12 is not attached or secured to die 38 such as by vacuum forces allowing blank 12 to slide relative to die 38 such that fold lines 20 tend to be coextensive with the lateral edges of central portion 40. The bowing of panel 16 by suction cups 78 reduces the longitudinal spacing of fold lines 20 less than the longitudinal edges of central portion 40 and assists the sliding of blank 12 relative to die 38 such that fold lines 20 are coextensive with the lateral edges of central portion 40. With continued movement of die 38 towards conveyor assembly 34, blank 12 is pushed into the female cavity and has a generally U-shape with side walls 18 extending generally perpendicular to base panel 16 when panel 16 is sandwiched between central portion 40 and conveyor assembly 34 between lugs 36 and side walls 18 are sandwiched between leg portions 42 and lugs 36. It should be appreciated that when blank 12 is sandwiched between die 38 and conveyor assembly 34, bumpers 74 also engage end walls 22 to hold them generally planar to panel 16 and possibly with edges 27 located slightly below panel 16.

It should be kept in mind that while die 38 is moving toward conveyor assembly 34, die 38 is also moving at the same constant speed and direction as lugs 36. After blank 12 is sandwiched between die 38 and conveyor assembly 34 and while still sandwiched, the leading lateral edges of end walls 22 pass beneath the trailing ends of stationary guides 146 located on opposite sides and parallel to conveyor assembly 34. After end walls 22 are beneath guides 146 and while die 38 continues to move at the same speed and direction as lugs 36, die 38 is moved in the slide direction away from conveyor assembly 34 perpendicular to the movement direction of lugs 36 which is vertically upward in the most preferred form. When die 38 is located above lugs 36, die 38 and provisions 44 are moved opposite to the movement direction of lugs 36 back to its initial position by pivoting pivot levers 50 towards magazine 96. It should be noted that when die 38 moves away from conveyor assembly 34, the positioning of end walls 22 beneath guides 146 holds blank 12 in the partially set-up condition between lugs 36. In the partially set-up condition, product can be introduced onto panel 16 such as by sliding through the open ends and thereafter end walls 22 folded upwardly and tabs 28 secured to side walls 18 in any desired manner.

In the most preferred form, apparatus 10 partially sets-up blanks 12 in every other pair of lugs 36 and a second apparatus 10 is provided to partially set-up blanks 12 in the alternate pair of lugs 36 such that blanks 12 are positioned between every pair of lugs 36. Cam drive 56 can be utilized to drive both apparatus 10 in this situation with suitable linkage between the two apparatus 10.

Apparatus 10 according to the teachings of the present invention maintains control over blank 12 at all times. Specifically, blank 12 initially positioned in magazine 96 is removed by and under control of suction cups 122. Blank 12 is under control of suction cups 78 before suction cups 122 are released. Blank 12 is under control of die 38 and conveyor assembly 34 before suction cups 78 are released. Likewise, blank 12 is under control of guides 146 and conveyor assembly 34 before sandwiching by die 38 is released. Since control of blank 12 is continually maintained at all times, there is less tendency to incorrectly set-up blank 12. Also, in this regard, the accuracy of placement of blanks 12 relative to lugs 36 is greatly dependent on the accuracy of attachment of suction cups 122 to blank 12. As the lower edges of end walls 22 are cut edges and located closer to the center of blank 12 than the lower edge of the lower side wall 18, better accuracy of attachment of suction cups 122 occurs than if the lower edge of side wall 18 was supported on supports 98 of magazine 96 due to the tendency of blanks 12 formed of paperboard to be bowed in various directions.

Apparatus 10 according to the teachings of the present invention is then particularly advantageous in allowing high speed operation and specifically has the ability to partially set-up approximately 100 blanks per minute. Specifically, provisions 44, 76, and 108 are constructed to be in non-interfering relations allowing their return to their initial positions as soon as control of blank 12 is passed on to the next operation step. Further, the mass and inertia of provisions 44, 76, and 108 has been minimized to allow abrupt changes in movement direction. This is a major advantage in conjunction with operation of conventional production of soft drink can-type products.

Now that the basic teachings of the present invention have been explained, many extensions and variations will be obvious to one having ordinary skill in the art. For example, although apparatus 10 of the most preferred form includes the combination of several, unique features believed to obtain synergistic results, apparatus for handling blanks could be constructed according to the teachings of the present invention including such features singly or in other combinations.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Apparatus for partially setting up a blank, with the blank including a base panel and first and second side walls secured on opposite sides of the base panel about fold lines, comprising, in combination: a forming die having a central portion generally corresponding to the shape and size of the base panel; a female cavity for slideably receiving the die in a slide direction; means for moving the female cavity in a movement direction at a non-linear angle to the slide direction at a constant speed; suction cups for removable securement to the blank, with the suction cups being adapted to removably secure to the base panel opposite to the forming die; means for moving the suction cups from an initial position in the movement direction at the constant speed for releasably holding the blank over the female cavity for movement in the movement direction at the constant speed; and means for moving the forming die from an initial position spaced in the slide direction from the female cavity in the movement direction at the constant speed and in the slide direction for pushing the blank into the female cavity, with the suction cups moving in the slide direction out of the female cavity and opposite to the forming die moving into the female cavity and then relative to the female cavity opposite to the movement direction back to the initial position, with the forming die then moving in the slide direction out of the female cavity and then opposite to the movement direction back to the initial position.

2. The apparatus of claim 1 wherein the female cavity moving means comprises a conveyor assembly, with the conveyor assembly including lugs secured at longitudinally spaced locations to a chain, with the female cavity defined by and between the lugs.

3. The apparatus of claim 2 wherein the suction cup moving means comprises means for moving the suction cups from the initial position spaced in the slide direction from the female cavity on the same side of the female cavity as the forming die and in the slide direction into the female cavity.

4. The apparatus of claim 3 wherein the blank includes an inside surface, an outside surface, and a lower edge; and wherein the apparatus further comprises, in combination: a magazine for holding a plurality of blanks in an abutting relation with the outside surface abutting with the inside surface of the preceding blank and at a spaced position from the female cavity, with the magazine including a stop for abutting with the outside surface of a first blank of the plurality of blanks adjacent to the lower edge; and means for removing the first blank from the magazine and moving the first blank to an intermediate position, with the removing means moving the first blank in a blank direction parallel to the outside surface to move the lower edge to pass over the stop and simultaneously in the movement direction; wherein the removing means comprises, in combination: a pivot arm pivotable about a stationary frame axis and having a first end spaced from the frame axis; and means mounted to the first end of the pivot arm for removable securement to the outside surface of the blank, with the frame axis of the pivot arm located in the movement direction ahead of the lower edge so that the removable securement means moves along an arc around the frame axis of the pivot arm.

5. The apparatus of claim 4 wherein the blank includes an upper portion, with the removable securement means comprising means for removable securement to the outside surface of the upper portion of the blank; and wherein the apparatus further comprises, in combination: a stationary abutment bar positioned in the movement direction ahead of the first blank and in the slide direction below the first blank but above the lugs, with the lower portion of the blank being supported by the abutment bar above the lugs when the lower edge passes over the stop.

6. The apparatus of claim 5 wherein the blank includes first and second end walls secured on opposite ends of the base panel about fold lines, with the end walls including the lower edge, with the first side wall extending in the slide direction below the lower edge.

7. The apparatus of claim 4 wherein the removable securement means is pivotally mounted to the first end of the pivot arm about an arm axis spaced and parallel to the axis of the pivot arm; and wherein the apparatus further comprises, in combination: means for pivoting the removable securement means about the arm axis to be in a nonabutting relation with the outside surface of the blank after the first blank is moved to the intermediate position.

8. The apparatus of claim 3 wherein the suction cup moving means comprises, in combination: a pivot lever having a first end pivotally mounted about a lever axis and having a second end; a link having a first end pivotally mounted to the second end of the pivot lever about a link axis spaced from and parallel to the lever axis; means for pivoting the pivot lever about the lever axis; and means for pivoting the link about the link axis.

9. Apparatus for handling a blank including an inside surface, an outside surface, and a lower edge, comprising, in combination: a magazine for holding a plurality of blanks in an abutting relation with the outside surface abutting with the inside surface of the preceding blank and extending in a magazine direction, with the magazine including a stop for abutting with the outside surface of a first blank of the plurality of blanks adjacent to the lower edge; and means for removing the first blank from the magazine and moving the first blank to an intermediate position, with the removing means moving the first blank in a blank direction parallel to the outside surface to move the lower edge to pass over the stop and simultaneously in the magazine direction;

wherein the removing means comprises, in combination: a pivot arm pivotable about a stationary frame axis and having a first end spaced from the frame axis; and means mounted to the first end of the pivot arm for removable securement to the outside surface of the blank, with the frame axis of the pivot arm located in the magazine direction ahead of the lower edge so that the removable securement means moves along an arc around the frame axis of the pivot arm.

10. The apparatus of claim 9 wherein the blank includes an upper portion, with the removable securement means comprising means for removable securement to the outside surface of the upper portion of the blank; and wherein the apparatus further comprises, in combination: a stationary abutment bar positioned in the magazine direction ahead of and below the first blank, with the lower portion of the blank being supported by the abutment bar when the lower edge passes over the stop and when the upper portion of the blank is removably secured to the removable securement means.

11. The apparatus of claim 10 wherein the magazine holds the blanks each further including a base panel, first and second side walls secured on opposite sides of the base panel about fold lines, and first and second end walls secured on opposite ends of the base panel about fold lines, with the end wall including the lower edge, with the first side wall extending opposite to the blank direction below the lower edge; and wherein the stop abuts the end walls adjacent to the lower edge.

12. The apparatus of claim 9 wherein the removable securement means is pivotally mounted to the first end of the pivot arm about an arm axis spaced and parallel to the axis of the pivot arm; and wherein the apparatus further comprises, in combination: means for pivoting the removable securement means about the arm axis to be in a nonabutting relation with the outside surface of the blank after the first blank is moved to the intermediate position.

13. Method for partially setting up a blank, with the blank including a base panel and first and second side walls secured on opposite sides of the base panel about fold lines, comprising the steps of: providing a forming die having a central portion generally corresponding to the shape and size of the base panel; providing a female cavity for slideably receiving the die in a slide direction; moving the female cavity in a movement direction at a non-linear angle to the slide direction at a constant speed; releasably holding the blank over the female cavity by suction cups for movement in the movement direction at the constant speed; moving the forming die from an initial position spaced in the slide direction from the female cavity in the movement direction at the constant speed and in the slide direction for pushing the blank into the female cavity and simultaneously moving the suction cups in the slide direction out of the female cavity; moving the suction cups opposite to the movement direction after the suction cups are out of the female cavity; and continuing to move the forming die in the movement direction after the suction cups are out of the female cavity and then in the slide direction out of the female cavity.

14. The method of claim 13 wherein the blank includes an inside surface, an outside surface, and a lower edge; and wherein the method further comprises the steps of: holding a plurality of blanks in a magazine in an abutting relation with the outside surface abutting with the inside surface of the preceding blank and at a spaced position from the female cavity, with the magazine including a stop for abutting with the outside surface of a first blank of the plurality of blanks adjacent to the lower edge; removably securing to the outside surface of the blank; moving the removable securement along an arc around a stationary frame axis located in the magazine direction ahead of the lower edge for removing the first blank from the magazine by moving the first blank in a blank direction parallel to the outside surface to move the lower edge to pass over the stop and simultaneously in the movement direction; and then continuing to move the removable securement along the arc for moving the first blank to an intermediate position.

15. Method for handling a blank including an inside surface, an outside surface, and a lower edge, comprising the steps of: holding a plurality of blanks in a magazine in an abutting relation with the outside surface abutting with the inside surface of the preceding blank and extending in a magazine direction, with the magazine including a stop for abutting with the outside surface of a first blank of the plurality of blanks adjacent to the lower edge; removably securing to the outside surface of the blank; moving the removable securement along an arc around a stationary frame axis located in the magazine direction ahead of the lower edge for removing the first blank from the magazine by moving the first blank in a blank direction parallel to the outside surface to move the lower edge to pass over the stop and simultaneously in the magazine direction; and then continuing to move the removable securement along the arc for moving the first blank to an intermediate position.

16. The method of claim 15 wherein the removably securing step comprises the step of removably securing to the outside surface of an upper portion of the blank; and wherein the method further comprises the step of supporting a lower portion of the blank by a stationary abutment bar positioned in the magazine direction ahead of and below the first blank when the lower edge passes over the stop and when the removable securement continues to move to the intermediate position.

17. The method of claim 16 further comprising the step of moving the removable securement about a movable axis after the intermediate position to a nonabutting relation with the outside surface of the blank, with the movable axis moving around the stationary frame axis.

18. The method of claim 13 wherein the removably holding and the suction cup moving steps comprise the steps of: pivoting a pivot lever about a lever axis, with the pivot lever having a first end pivotally mounted about the lever axis and having a second end; and pivoting a link having a first end pivotably mounted to the second end of the pivot lever about a link axis spaced from and parallel to the lever axis.

19. The method of claim 13 wherein the forming die moving and continuing steps include the step of:

reciprocating the forming die in and opposite to the movement direction.

20. The method of claim 13 wherein the forming die moving and continuing steps comprise the steps of:

reciprocating a slide block in a direction parallel to the movement direction; and reciprocating the forming die relative to the slide block in the slide direction.

21. The apparatus of claim 8 wherein the link pivoting means comprises, in combination: a linkage having a first end and a second end; a crank arm pivotably mounted about an axis; and means for pivoting the crank arm, with the first end of the linkage being pivotally mounted to the crank arm, with the link having a second end pivotally mounted to the second end of the linkage.

22. The apparatus of claim 1 wherein the forming die moving means includes means for reciprocating the forming die in and opposite to the movement direction.

23. The apparatus of claim 22 wherein the forming die moving means comprises, in combination: a slide block; means for reciprocating the slide block in a direction parallel to the movement direction; and means for reciprocating the forming die relative to the slide block in the slide direction.

24. The apparatus of claim 23 herein the forming die reciprocating means comprises, in combination: a rod secured to the forming die and slideably received in the slide block, and means for reciprocating the rod in the slide block.

* * * * *